United States Patent [19]

Benilan

[11] 4,240,255

[45] Dec. 23, 1980

[54] INTEGRATED CONTROL DEVICE FOR A FLUID CIRCUIT AND APPLICATIONS THEREOF

[75] Inventor: Jacques Benilan, Paris, France

[73] Assignee: Les Applications Hydrauliques R. Sarrazin S.A., Fontenay sous Bois, France

[21] Appl. No.: 44,156

[22] Filed: May 31, 1979

[30] Foreign Application Priority Data

Jun. 1, 1978 [FR] France ..... 78 16390

[51] Int. Cl.[3] ..... F15B 13/042; F15B 21/04

[52] U.S. Cl. ..... 60/453; 60/458; 60/460; 60/461; 60/468; 91/420; 137/106; 137/116

[58] Field of Search ..... 60/458, 460, 461, 477, 60/DIG. 10, 468, 494, 453; 91/420; 137/106, 116

[56] References Cited

U.S. PATENT DOCUMENTS

| | | | |
|---|---|---|---|
| 2,032,284 | 2/1936 | Johnston | 137/116 |
| 2,855,945 | 10/1958 | Gratzmuller | 60/468 X |
| 3,933,167 | 1/1976 | Byers | 91/420 X |

*Primary Examiner*—Irwin C. Cohen
*Attorney, Agent, or Firm*—Kenyon & Kenyon

[57] ABSTRACT

The device comprises in a body a pressure limiting stage, a second stage constituting a fluid check and retarding valve and piloting means between these two stages. The second stage comprises regulating means which are easily accessible from outside the body. The device is particularly compact and is of high interest, for example when it is incorporated in a self-contained cylinder structure.

18 Claims, 3 Drawing Figures

INTEGRATED CONTROL DEVICE FOR A FLUID CIRCUIT AND APPLICATIONS THEREOF

DESCRIPTION

The present invention relates to fluid control devices and in particular those employed for controlling so-called "self-contained" cylinder structures, that is to say double-acting linear cylinder structures equipped with their own pumping unit formed by a motor and a pump.

Such structures generally comprise, in addition to the motor and the pump, a control unit which is disposed in a reservoir so that access thereto is difficult, which does not permit particular regulations when the apparatus is in use. In other structures, certain components are arranged independently in the form of "cartridges" and are incorporated in the circuit while they are accessible from outside. However, in this case, there are components which perform only a signle function so that, irrespective of the configuration, the result is an assembly which is space-consuming and relatively expensive.

There is disclosed in DOS No. 24 45 699 of West Germany a check and flow retarding valve the opening of which is controlled by a rod and a piston subjected to a piloting pressure. However, this arrangement does not ensure the regulation of the nominal pressure in the circuit and additional means must be provided for this purpose, together with a path for the piloting pressure.

In another device disclosed in DOS No. 25 59 029 of West Germany, there are combined in a sub-assembly a piloted balancing valve and a check valve. Apart from the fact that such a balancing valve has well-known drawbacks, and in particular the fact that it does not permit a regulation of the speeds, such a sub-assembly does not include the function of controlling the nominal pressure in the circuit.

An object of the present invention is consequently to provide an integrated control device for a fluid circuit which performs a plurality of functions, is of small size, cheap and permits cartridge mounting. Further, such a device must enable the necessary regulations to be effected easily.

According to the invention, there is provided an integrated control device for a fluid circuit comprising a body provided with means for incoporating it in such a circuit, the device comprising a first pressure limiting stage, a second stage constituting a check and fluid flow retarding valve and means interposed between the two stages for piloting the check and retarding valve by means of the pressure established by the limiting stage, said two stages and the piloting means being disposed in coaxial relation in a cavity which extends throughout the body.

According to other features:

- the cavity defined in the body comprises a first part in which a first mounted element defining a seat for a closure member is fixed, said element being hollowed out so as to receive the closure member, a calibrating spring, and means defining a bearing face for the spring, the internal volume of said mounted element communicating with a a chamber of the body which is connected to the exhaust or tank, means being provided for regulating the position of the means defining the bearing face for the spring;
- the cavity defined in the body comprises a second part for a second mounted element which defines a guide surface for a piloting piston, a bearing surface for a return spring for the piston and a seat for the closure member of the check valve;
- the end of the piloting piston directly faces the end of the first mounted element and means are provided for maintaining the piston spaced from the first mounted element.

In a particular application, such a device is associated with a cylinder structure, the chamber defined between the pressure limiting stage and the piloting piston being connected to a source of fluid under pressure and to a first working chamber of said structure, a second chamber of which structure is connected to the second check and retarding stage.

Another object of the invention is to provide a self contained cylinder structure comprising a motor, a body forming a reservoir for the fluid, a pump driven by the motor and associated with a control device, and a base on which is fixed an assembly comprising a cylinder and a cylinder rod, said cylinder comprising two integrated control devices as defined above which are incorporated in the base and suitably connected, on one hand, to the pump and, on the other, to the two working chambers of the cylinder structure.

According to other features:

- the body forming a reservoir comprises two parts disposed on each side of the base and communicating by passages formed in said base, one of said parts surrounding in the known manner the pump and the other part surrounding the whole of the cylinder structure;
- the second part of the body and the whole of the cylinder structure are mounted on an axial extension of the base and fixed to the latter by at least one resiliently yieldable ring;
- the motor, the pump and the first part of the reservoir are fixed to the base by means of rods, the pump and the reservoir being clamped between a side wall of the motor and a face of the base;
- the suction orifice of the pump is in the vicinity of the longitudinal axis of the cylinder structure and, when the latter is mounted to pivot about two trunnions, in the vicinity of the point of intersection between the axis of said trunnions and the longitudinal axis of the cylinder structure.

The invention will now be described in more detail with reference to the accompanying drawings which are given solely by way of example and in which:

FIG. 1 shows an integrated control device comprising a body 1 provided with mounting means (not shown) whereby it can be incorporated in a fluid control circuit. Formed in the body 1 is a cavity which has an axis X—X and extends throughout the body and comprises three main parts:

Figure 1:
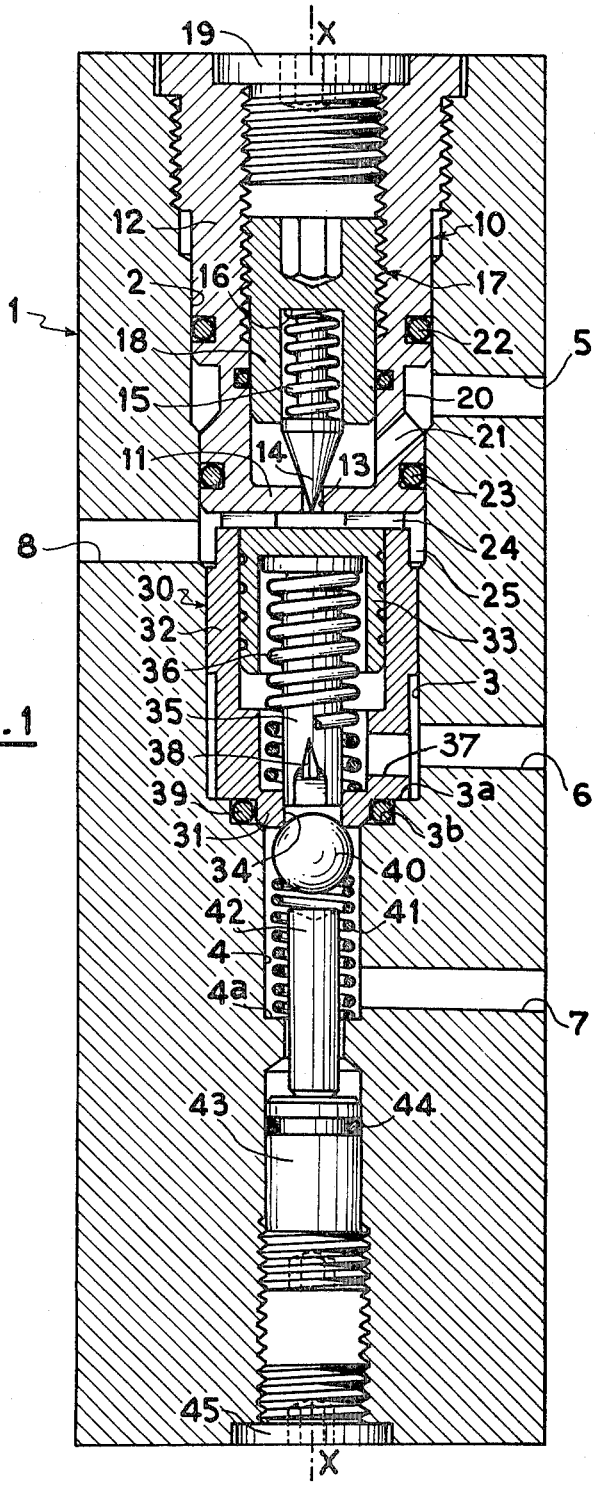
FIG. 1 is a longitudinal sectional view of an integrated control device according to the invention.

- an upper part 2 which receives a pressure limiting stage;
- an intermediate part 3 which receives piloting means which are actuated by the pressure determined by the limiting stage;
- a lower part 4 which corresponds to a stage comprising a check valve and a retarding device.

These three parts will be described in succession.

The pressure limiting stage comprises a first mounted element 10 which is fixed in the body by screwthreads. The element 10 is hollowed out and has an end or bottom wall 11 and a lateral wall 12. The end wall of this element defines an orifice 13 and acts as a seat for a closure member 14 which has a conical shape in the presently-described embodiment. This closure member is maintained in its closing position by a spring 15 which bears against the end wall 16 of a member 17 which is adjustably screwed into the first mounted element 10. The screw 17 further comprises a skirt 18 which is received in a sealed manner in the element 10. The latter is closed by a plug 19 at its other end. It further comprises a circumferential groove 20 which communicates by way of one or more passages 22 with its inner hollow and with a pipe 5 provided in the body 1 for connection to the tank. Sealing elements 22, 23 are provided between this mounted element and the adjacent wall of the body.

In its intermediate part 3, the body 1 receives in a substantially sealed manner a second mounted element 30 which may be merely maintained by the element 10 against a radial shoulder $3^a$ formed in the body or may be screwed into the latter. This second element is also hollowed out and comprises an end or bottom wall 31 and a lateral wall 32 which guides a piston 33 whose end directly faces the end wall 11 of the element 10. In order to maintain a gap between the second element 30 and the piston 33, on one hand, and the first mounted element 10, on the other, the element 10 has on its outer face a spider member 24 or any other like means. This gap constitutes a chamber 25. The end wall of the second mounted element is provided with an orifice 34 and constitutes a seat for a ball 40 of a check valve. The orifice 34 also allows the passage of a plunger 35 which is rigid with the piston 33, or bears against the end of the latter, and is biased upwardly as viewed in the drawing by a spring 36 which bears against the end wall 31 of the element 30. The inside volume of the latter communicates with the volume defined by the adjacent part of the body by way of at least one orifice 37. This part of the body is moreover also connected to the tank by way of a pipe 6.

According to a particularly interesting feature, the end of the plunger 35 adjacent to the check valve 40 has a profile of variable section so as to define with the end wall of the element 30 a passage whose free section varies in accordance with the axial position of the plunger. The latter may have for this purpose any suitable shape and comprise, for example, oblique slots 38. A sealing element 39 is provided between the end wall 31 and a radial shoulder $3^b$ of the body 1.

In its lower part 4, the body defines a stepped bore of smaller section comprising, in an intermediate part, a radial shoulder $4^a$ against which bears a spring 41 which acts on the ball 40 so as to apply it against its seat. The chamber defined by the body between this shoulder and the second mounted element is connected to a fluid return pipe 7. Also provided in this part of the body is an abutment finger member 42 which determines the travel of the check valve 40 under the action of the plunger 35, the position of this abutment being determined by an adjusting screw 43 including a sealing element 44.

The lower part (as viewed in the drawing) of the bore of the body is also closed by a sealed plug 45.

In order to explain the operation of such a device, it will be assumed that the chamber 25 is connected by a pipe 8, on one hand, to a source of fluid under pressure (pump 50 in FIG. 2) and, on the other hand, by way of a check valve 51, to a working chamber 52 of a cylinder structure 53. The pipe 7 is assumed to be connected to the second chamber 54 of the cylinder structure and therefore receives fluid from this second chamber. The pipes 5 and 6 and the suction pipe 53 of the pump associated with two check valves 56, 57 are connected to a fluid reservoir 58. In the diagram shown in FIG. 2, the pump 50 has two directions of rotation and it will be understood that the diagram may be completed for controlling a double-acting cylinder structure 53, by a second circuit which is equivalent to that illustrated and supplies fluid to the chamber 54 (from the pipe 59) and retards the fluid coming from the chamber 52.

There will now be explained merely the operation of the device for a sequence corresponding to the illustrated part of the diagram with reference mainly to FIG. 1.

In the absence of a fluid supply pressure in the chamber 25, the piston 33 occupies the illustrated position and the ball 40 of the check valve is applied against its seat 31 and therefore precludes the return of the fluid by way of the pipe 7.

As fluid under pressure is supplied to the chamber 25, the closure member 14 of the pressure limiter rises and establishes a given pressure in the circuit. This pressure is exerted on the piston 33 which moves downwardly and thereby pilots the opening of the check valve by moving the ball 40 away from its seat. The retarding function performed by this valve can then be performed in two different ways in accordance with an important feature of the invention, namely:

- if the free travel of the ball 40 is short, the retarding section is determined by the free passage between the ball and its seat;
- in a modification, it can also be arranged that the action of the piston 33 and of the plunger 35 on the ball produces first of all the opening of a practically free passage for the return fluid and thereby results in a decompression in the return circuit, followed by a limitation of the section of the passage which is then determined by the gap between the plunger 35 and the end wall 31 of the member 30.

Figure 2:
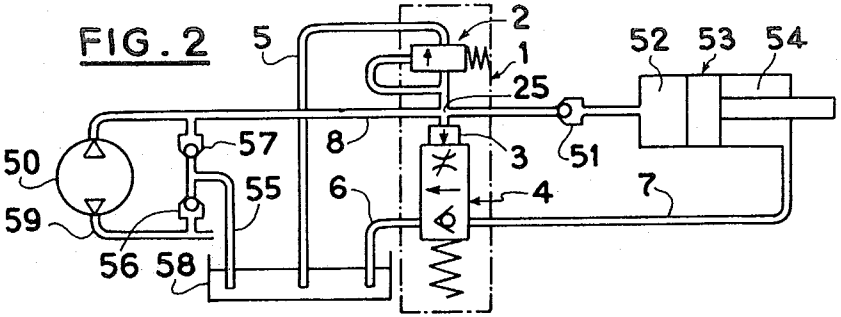
FIG. 2 is a diagram showing a particular application of such a device.

The main advantages of such a device are the following:

- there are available within an assembly of particularly small overall size means performing several functions: pressure limiter, check and retarding valve and piloting of this check valve by the pressure established by the limiter;
- the means 17 and 14 regulating the pressure limiter and the check valve are accessible from both ends of the body in a very convenient manner, since it is merely necessary to remove the plugs 19 and 45;
- the pressure limiter constitutes a sub-assembly which may be easily removed without modifying its regulation, this removal permitting access to the piloting means and to the check valve;
- in view of the position of the pressure limiter and of the piloting piston, the pressure which acts on the latter is exactly the same as that which prevails in the limiter and this imparts to the device a high operational precision;
- as mentioned above, it is possible, by a simple regulation, to have two different modes of operation of the check and retarding valve, this retarding being obtained either immediately, or after passage through a position which authorizes a roughly free passage for the fluid and thus results in a decompression of the return circuit; it is this latter configuration which is shown in the diagram of FIG. 2.

According to another modification, with the element 30 locked in the body 1 and with the spider member 24 or like means having such radial size that it does not interfere with this element 30, it is possible, by screwing the element 10 in the body, to maintain the ball 40 away from its seat in a positive manner, which may be of particular interest, for example for obtaining a free movement of the associated cylinder structure.

Figure 3:
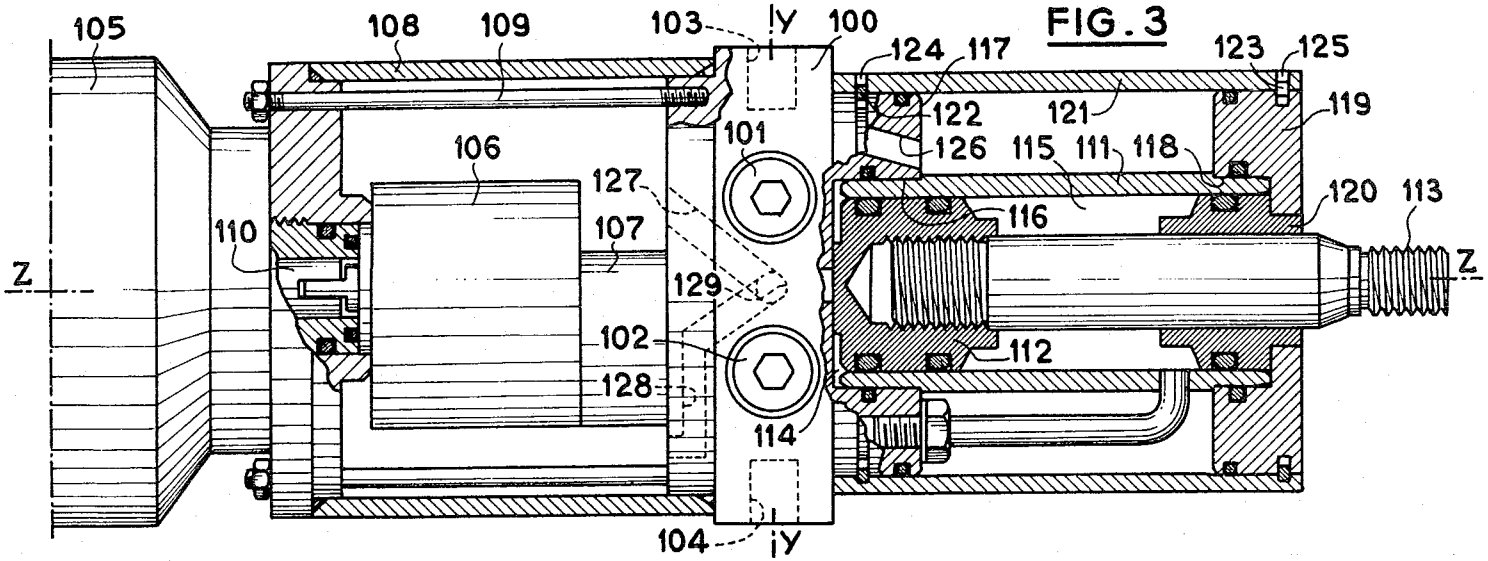
FIG. 3 is a view, partly in side elevation and partly in section, of a self-contained cylinder structure arranged in accordance with the invention.

FIG. 3 shows diagrammatically a so-called self-contained cylinder structure, that is to say a structure comprising a motor and a pump incorporated therein and including two control devices according to the invention disposed in a common body which is here formed by a base 100. These two control devices are designated by the reference numerals 101 and 102 and only plugs which correspond to the plug 19 in FIG. 1 can be seen. Also provided in this base are two cavities 103, 104 for trunnions which have an axis Y—Y perpendicular to the axis Z—Z of the cylinder structure.

The latter comprises an electric motor 105, a pump 106 associated with a valve unit 107 which corresponds to the valves 56, 57 in FIG. 2. This pump is surrounded by a cylindrical body 108 and the assembly comprising the motor, the pump and the body 108 is fixed to the base 100 by tie rods 109 or other like fixing means. A drive connection is moreover provided between the output shaft 110 of the motor and the pump.

Mounted on the other side of the base is a cylinder structure proper formed by a cylinder 111 in which is received a piston 112 rigid with a rod 113, the piston and the cylinder defining two chambers 114 and 115. The cylinder 111 is received in a bore 116 in an axial extension 117 of the base. It is also received in a bore 118 formed in an end wall 119 which carries a ring 120 guiding the rod 113. This assembly is completed by a cylindrical body 121 which is rendered rigid with the extension 117 of the base and with the end wall 119 by means of resiliently yieldable rings 122, 123 received in circumferential grooves in these various parts. In order to permit an easy disassembly, there are provided in various places, for example at three places disposed at 120° from each other, orifices, such as 124, 125, formed in the cylindrical body 121 and allowing the resilient rings to be compressed.

The various pipes which provide hydraulic connections between the pump, the control devices 101, 102, the chambers 114, 115 of the cylinder structure and the fluid reservoirs defined by the bodies 108 and 121, have not been shown in detail in this drawing. The design of these various connections is obvious to one skilled in the art and therefore do not require a detailed description. It will merely be mentioned that the base has passages putting the two parts of the reservoir in communication with each other, and that the returns to the tank of the pump and of the control devices occur by way of a common pipe 126 which communicates with the part of the reservoir defined by the body 121. Fluid filtering means may be provided in the passages through the base. On the other hand, the pump draws fluid from the part of the reservoir defined by the body 108, for example, by way of pipes 127, 128 which converge to a point 129 which is as close as possible to the point of intersection of the two axes Y—Y and Z—Z. In this way there is ensured a good circulation of the fluid which improves the cooling thereof, and a correct supply of fluid to the pump irrespective of the variations in the position of the cylinder structure so that the presence of compensators is unnecessary in most cases.

Such a cylinder structure operates in the conventional manner. On the other hand, its original construction provides a number of advantages:

- first, its overall length is particularly small since the control unit which was usually interposed between the pump and the base is here incorporated in the latter;
- the two pressure limiters and the two regulating screws of the retarding means of the return paths are easily accessible from outside, which permits an easy regulation of all of the functions of the device;
- the assembly and the disassembly of the assembly are particularly easy and rapid;
- risks of leakage are reduced since the number of sealing elements is small relative to the conventional assembly;
- as the fluid reservoir is partly defined by the cylindrical body surrounding the active part of the cylinder structure, its volume is thus proportional to the travel of the cylinder structure with no other modification necessary;
- the surface of heat exchange with the exterior is increased and this promotes an improved cooling; this surface may moreover be increased by the use of fins or like means.

Having now described my invention what I claim as new and desire to secure by Letters Patent is:

1. Integrated control device for a fluid circuit, comprising a body which is provided with passage means for incorporating the device in such a circuit, and defining a cavity extending throughout the body, a first pressure limiting stage, a second stage comprising a fluid flow check and retarding valve and means disposed between said two stages for piloting the check and retarding valve by the pressure established by the limiting stage, said first stage comprising first wall means mounted in the cavity and defining a first orifice and a first valve seat surrounding the first orifice, a first closure member movably mounted relative to the body and cooperative with the valve seat, and resiliently yieldable means biasing the first closure member against the first valve seat, said second stage comprising second wall means mounted in the cavity and defining a second orifice and a second valve seat surrounding the second orifice, a second closure member disposed in a part of said cavity and movable relative to the body and cooperative with the second valve seat, and elastically yieldable means biasing the second closure member against the second valve seat, said piloting means comprising means defining a chamber in said cavity which chamber has one end defined by said first wall means, a piloting piston slidably mounted in said chamber and having an end wall which is in direct confronting relation to said first orifice, elastically yieldable means biasing the piloting piston toward said first orifice, means maintaining the piloting piston spaced away from said first wall means and thereby providing a space in said cavity between said first wall means and the piloting piston, and rigid means combined with the piloting piston for enabling the piloting piston to urge the second closure member away from the second seat as the piloting piston moves away from said first wall means, said passage means comprising a first passageway communicating with said space and for connecting to a fluid supply part of said circuit, a second passageway for connection to a fluid return part of said circuit and communicating with a part of said cavity in which said second closure member is disposed, a third passageway for connection to a reservoir of said circuit and communicating with said chamber, and a fourth passageway for connection to said reservoir of said circuit and communicating with a side of said first wall means remote from said chamber, said first closure member and said piloting piston being in coaxial relation in said cavity.

2. Integrated control device for a fluid circuit, comprising a body which is provided with passage means for incorporating the device in such a circuit, and defining a cavity extending throughout the body, a first pressure limiting stage, a second stage comprising a fluid flow check and retarding valve and means disposed between said two stages for piloting the check and retarding valve by the pressure established by the limiting stage, said two stages and the piloting means being disposed coaxially in the cavity, said first stage comprising a closure member mounted in a part of the cavity and a first element mounted in the cavity and defining an orifice and a seat for the closure member, said first element being hollow and receiving the closure member therein, a calibrating spring engaging the closure member and a member mounted in the first element and defining a bearing face for an end of the spring remote from the closure member, the device further comprising means defining a chamber in the body and means for connecting the chamber to a fluid reservoir, the interior of the first element communicating with the chamber by way of said orifice, and means for regulating the axial position of the member defining the bearing face for the spring relative to said orifice.

3. Device as claimed in claim 2, wherein the two stages comprise regulating means which are accessible from outside the body.

4. A device as claimed in claim 2, comprising a second element which is mounted in a part of the cavity and defines a guide surface and a bearing surface and a second seat, said second stage comprising a second closure member disposed in said cavity and cooperative with the second seat and said piloting means comprising a piloting piston guided by the guide surface, and a return spring interposed between the piston and the bearing surface of the second element.

5. A device as claimed in claim 4, wherein an end of the piloting piston directly faces an end of the first element and means are provided for maintaining said piston spaced from the first element.

6. A device as claimed in claim 4, wherein the second element is hollow and has an interior which communicates by way of an orifice with the adjacent cavity of the body and a pipe is provided in the body for connecting the interior of the second element and the cavity to a tank.

7. A device as claimed in any one of the claims 2 to 6, wherein the cavity has a part which is separated from the part receiving the second element by the check valve and a pipe is provided for connecting said part separated from the part receiving the second element to a fluid return path.

8. A device as claimed in claim 4, comprising abutment means cooperative with the closure member of the second stage for determining the travel of the closure member, the abutment means being adjustable from outside the body.

9. A device as claimed in any one of the claims 2 to 6, comprising a rod rigid with the piloting piston, the rod being so arranged as to act as plunger for shifting the closure member of the second stage away from its seat and to cooperate with the second element so as to define a variable throttling for the passage of the fluid.

10. A device as claimed in claim 9, wherein the travel of the closure member of the check and retarding valve is such that there is established first of all a practically free passage for the fluid prior to the throttling determined by the plunger.

11. A self-contained cylinder structure comprising a motor, a case forming a reservoir for the fluid, a pump driven by the motor and associated with a control device and a base, an assembly fixed on the base and comprising a cylinder, a piston slidable in the cylinder and defining two working chambers in the cylinder and a rod connected to the piston, the cylinder structure comprising two integrated control devices incorporated in the base and suitably connected to the pump and moreover to the two working chambers in the cylinder, each of said control devices comprising a body which is provided with means for connecting the device to said pump and to said working chambers of the cylinder and defining a cavity extending throughout the body, a first pressure limiting stage, a second stage comprising a fluid flow check and retarding valve and means disposed between said two stages for piloting the check and retarding valve by the pressure established by the limiting stage, said two stages and the piloting means being disposed coaxially in the cavity.

12. A cylinder structure as claimed in claim 11, wherein the case forming the reservoir comprises two parts disposed on each side of the base and passages are provided in the base by way of which passages the two parts of the reservoir communicate with each other, one of said parts of the base surrounding the pump and the other part surrounding the cylinder.

13. A cylinder structure as claimed in claim 11, wherein the second part of the case and the cylinder are mounted on an axial extension of the base and fixed to the base by a resiliently yieldable ring.

14. A cylinder structure as claimed in claim 13, comprising an end wall between the cylinder and the case, the case being fixed to the end wall by a resiliently yieldable ring.

15. A cylinder structure as claimed in any one of the claims 10 to 14, comprising tie rods fixing the motor, the pump and the first part of the case forming a reservoir, the pump and the reservoir being clamped between a wall of the motor and a face of the base.

16. A cylinder structure as claimed in any one of the claims 11 to 14, wherein the pump has a suction orifice which is located in the vicinity of the longitudinal axis of the cylinder structure.

17. A cylinder structure as claimed in claim 16, comprising two coaxial trunnions mounted on the body about which trunnions the cylinder structure is pivotable, said suction orifice being located in the vicinity of a point of intersection between the axis of the trunnions and the longitudinal axis of the cylinder structure.

18. A cylinder structure as claimed in claim 12, comprising continuous filtering means disposed in said passages in the base.

* * * * *